US008783527B2

(12) United States Patent
Scott

(10) Patent No.: US 8,783,527 B2
(45) **Date of Patent: *Jul. 22, 2014**

(54) PRESSURIZED FLUID DISTRIBUTION SYSTEM

(71) Applicant: Advanced Carbonation Technologies, LLC, Stuart, FL (US)

(72) Inventor: Michael Alan Scott, Dunnellon, FL (US)

(73) Assignee: Advanced Carbonation Technologies, LLC, Stuart, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/010,794

(22) Filed: Aug. 27, 2013

(65) Prior Publication Data

US 2013/0341363 A1 Dec. 26, 2013

Related U.S. Application Data

(63) Continuation of application No. 13/011,141, filed on Jan. 21, 2011, now Pat. No. 8,544,701.

(60) Provisional application No. 61/297,007, filed on Jan. 21, 2010.

(51) Int. Cl.

| | |
|---|---|
| ***B65D 83/00*** | (2006.01) |
| ***B67D 1/12*** | (2006.01) |
| *B67D 1/04* | (2006.01) |

(52) U.S. Cl.

CPC ..... *B67D 1/1252* (2013.01); *B67D 1/1281* (2013.01); *B67D 1/0412* (2013.01)

USPC ..... 222/399; 222/3

(58) Field of Classification Search

CPC ... B67D 1/1252; B67D 1/1281; B67D 1/0412

USPC ..... 222/399, 2–4, 401, 402.18, 61, 64, 396; 137/590, 592, 206, 214

See application file for complete search history.

(56) References Cited

U.S. PATENT DOCUMENTS

| | | | | | |
|---|---|---|---|---|---|
| 597,024 | A | * | 1/1898 | Schmitz | 220/581 |
| 1,359,336 | A | | 11/1920 | Crell | |
| 1,605,619 | A | * | 11/1926 | Schreiner | 137/590 |
| 2,054,850 | A | | 9/1936 | Deming | |
| 2,880,910 | A | | 4/1959 | Hanson et al. | |
| 3,594,745 | A | | 7/1971 | Nickels | |
| 3,640,429 | A | * | 2/1972 | Campbell | 222/1 |
| 3,666,143 | A | | 5/1972 | Weston | |
| 3,877,484 | A | | 4/1975 | Theriot et al. | |
| 4,350,115 | A | | 9/1982 | Pasternack | |
| 4,375,789 | A | | 3/1983 | Bergeron | |
| 4,523,602 | A | | 6/1985 | Snyder | |
| 4,632,275 | A | | 12/1986 | Parks | |
| 4,782,861 | A | | 11/1988 | Ross | |

(Continued)

*Primary Examiner* — Lien Ngo

(74) *Attorney, Agent, or Firm* — Edell, Shapiro & Finnan, LLC

(57) ABSTRACT

A system for storing and monitoring a pressurized fluid includes a pressurized fluid source and a plurality of fluid lines in communication with the supply line of a fluid dispensing system. The fluid lines are configured to selectively permit the passage of the pressurized fluid when the pressure of the source (e.g., a tank) reaches a predetermined threshold value. Specifically, the tank includes a high pressure line, an intermediate pressure line, and a low pressure or reserve line.

20 Claims, 7 Drawing Sheets

(56) References Cited

U.S. PATENT DOCUMENTS

| | | | | |
|---|---|---|---|---|
| 4,928,728 | A | 5/1990 | Nakane et al. | |
| 4,969,576 | A | 11/1990 | Merrill et al. | |
| 5,007,614 | A | 4/1991 | Lockwood, Jr. | |
| 5,303,845 | A * | 4/1994 | Osawa | 222/1 |
| 5,320,252 | A * | 6/1994 | Fleming | 222/145.1 |
| 5,553,749 | A | 9/1996 | Oyler et al. | |
| 5,706,661 | A | 1/1998 | Frank | |
| 5,839,291 | A | 11/1998 | Chang | |
| 6,340,034 | B1 | 1/2002 | Arnott et al. | |
| 6,530,400 | B2 * | 3/2003 | Nelson | 141/2 |
| 6,578,365 | B2 | 6/2003 | Sicherman | |
| 6,807,460 | B2 | 10/2004 | Black et al. | |
| 6,820,763 | B2 * | 11/2004 | Bilskie et al. | 222/61 |
| 6,959,724 | B2 | 11/2005 | Heiderman | |
| 7,273,069 | B1 | 9/2007 | Nelson | |
| 2002/0088823 | A1 | 7/2002 | Tabacchi et al. | |
| 2006/0283877 | A1 | 12/2006 | Bodemann | |

* cited by examiner

PRESSURIZED FLUID DISTRIBUTION SYSTEM

CROSS REFERENCE TO RELATED APPLICATIONS

This application is a continuation of Nonprovisional application Ser. No. 13/011,141, filed 21 Jan. 2011 and entitled "Pressurized Fluid Distribution System for Beverage Dispensing," which is a nonprovisional of Provisional Application No. 61/297,007, entitled "Pressurized Fluid Distribution for Beverage Dispensing System" and filed on 21 Jan. 2010. The disclosure of each of the aforementioned applications is incorporated herein by reference in its entirety.

FIELD OF THE INVENTION

This invention relates to pressurized fluid storage and distribution system and, in particular, to a liquid $CO_2$ storage vessel including a fluid reserve. This invention may be utilized for beverage dispensing systems.

BACKGROUND OF THE INVENTION

Beverage dispensing systems are utilized to dispense beverages under pressure, such as soda or beer. These types of beverage systems require a pressurized fluid source (e.g., carbon dioxide) in order to dispense the beverage. By way of example, soda dispensers typically include a carbonator, a syrup pump, and a $CO_2$ source. The carbonator takes tap water and combines it with $CO_2$ gas (from the $CO_2$ source) to produce soda water. The carbonator may also include a booster pump that pressurizes the water up above the pressure of the $CO_2$ gas, causing the two to mix together. By way of further example, beer is stored under pressure in a container such as a keg. Over its lifespan, the beer (i.e., the container) will lose its original $CO_2$ amount; consequently, the beer is dispensed utilizing a $CO_2$ source to maintain the proper dispensing pressure. The level of $CO_2$ within a beverage system also affects the quality the beverage. Specifically, the $CO_2$ gas content of a beverage must be kept within a predetermined range—values above the desired range cause the beverage to become overly fizzy or foamy, while values below the desired range may cause the beverage to become flat and undrinkable.

In any beverage dispensing system, the $CO_2$ source becomes depleted over time. Once depleted, the beverage dispensing system is completely shut down until the $CO_2$ source is refilled. That is, the sales of product are interrupted until the source is refilled. The refilling process is time consuming since it involves the ordering and delivery of a fresh source, as well as installation by a technician. Thus, a problem occurs when the pressurized fluid in the $CO_2$ tank is depleted, since the beverage dispensed is no longer consumable. The depletion of a $CO_2$ source can be particularly problematic if the source is depleted without warning.

Many $CO_2$ systems merely run empty without warning. As a result, a user is unable to preemptively order additional $CO_2$ to prevent the interruption of beverage dispensing operations. Some systems include electronic sensors that continually monitor the fluid in the system. These electronic systems, however, are expensive, typically requiring computer equipment and software to manage the sensors. Even systems including a gauge that estimates the amount of fluid left in a tank are problematic because of the accuracy of the gauge, as well as the requirement that a user continually monitor the gauge to avoid unintentional depletion of the fluid.

Thus, it would be desirable to provide a pressurized gas source for a beverage dispensing system that notifies a user when the tank storing the pressurized fluid is nearly depleted and/or provides a reserve source of pressurized fluid that can be selectively activated after notification is received.

SUMMARY OF THE INVENTION

A system for storing and monitoring a pressurized fluid includes a pressurized fluid source and a plurality of fluid lines in communication with the supply line of a beverage dispensing system. The fluid lines are configured to selectively permit the passage of the pressurized fluid when the pressure of the source (e.g., a tank) reaches a predetermined threshold value. Specifically, the tank includes a high pressure line, an intermediate pressure line, and a low pressure or reserve line. In operation, the pressure of the tank decreases proportionately with decreasing fluid (liquid and gas) within the tank. Thus, as the pressurized fluid is drawn out of the tank, the fluid is selectively directed into the high pressure and intermediate pressure lines. When the pressure in the tank reaches a predetermined low value, fluid flow is temporarily discontinued to warn the user that fluid level is low and that depletion is imminent. To reactivate the flow, a user overrides the stop, e.g., by opening the reserve (low pressure) line to permit the remaining fluid in the tank to flow to the supply line.

BRIEF DESCRIPTION OF THE DRAWINGS

Like reference numerals have been used to identify like elements throughout this disclosure.

DETAILED DESCRIPTION OF THE INVENTION

Figure 1:
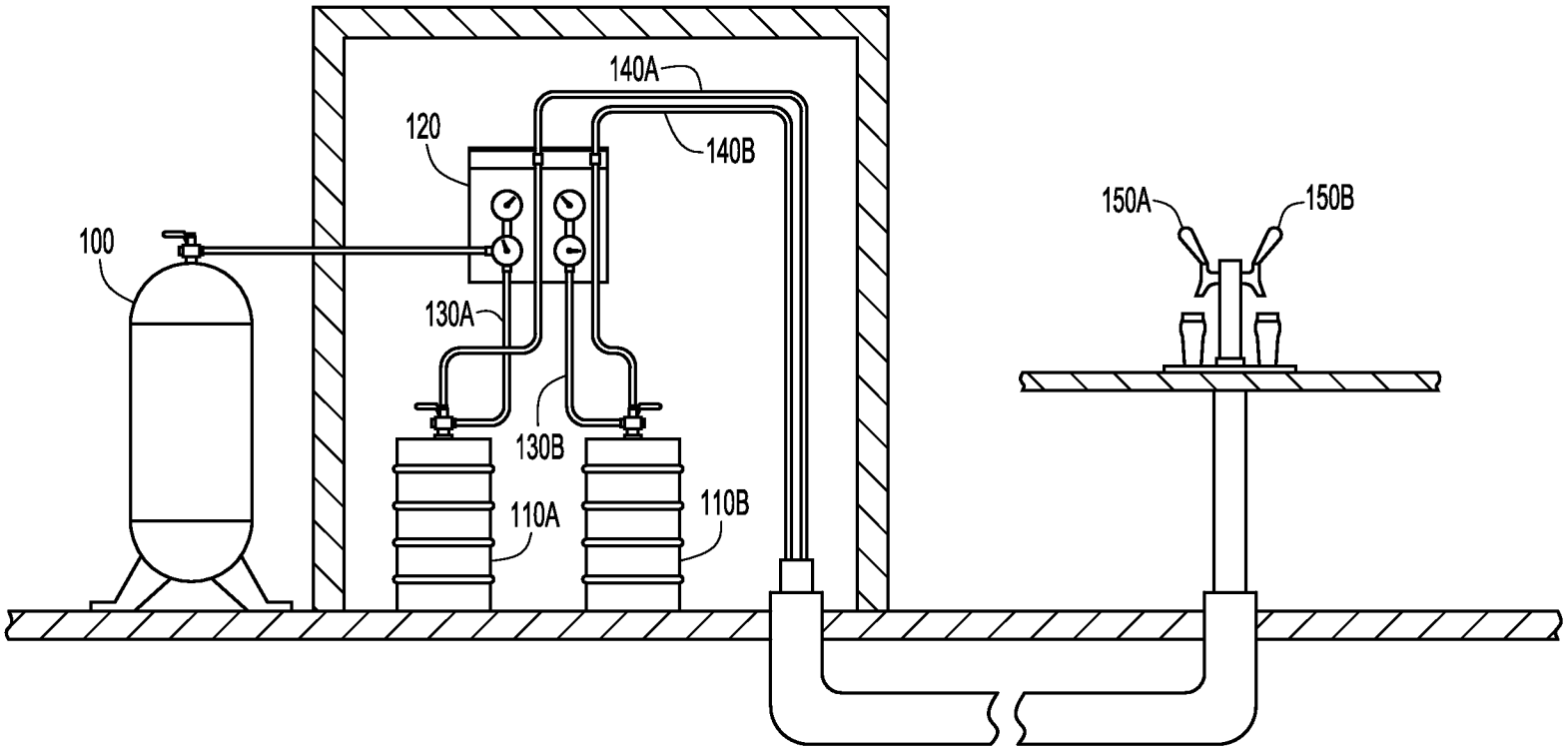
FIG. 1 illustrates a schematic of a beverage dispensing system including a pressurized fluid source.

FIG. 1 is a schematic of a beverage dispensing system (e.g., a beer dispensing system). As shown, the system 10 includes a storage vessel or tank 100 including a source fluid maintained under pressure (e.g., $CO_2$ or $N_2$), a beverage source 110A, 110B, a control module or regulator 120, supply conduits 130A, 130B, and dispensing conduits 140A. 140B. The beverage source may be containers including the beverage to be mixed with the pressurized fluid such as beer, soda syrup, etc. The control module or regulator 120 controls the amount of pressurized fluid mixed with the beverage in the beverage source 110A, 110B, as well as controls the flow of consumable beverage directed toward dispensers 150A, 150B via the dispensing conduits 140A, 140B. In operation, the pressurized gas from the tank 100 is directed into the beverage source 110A, 110B (e.g., a beer keg) at a predetermined ratio (controlled by the regulator 120) to draw the beverage out of the beverage source and to the dispensers 150A, 150B.

Figure 2:
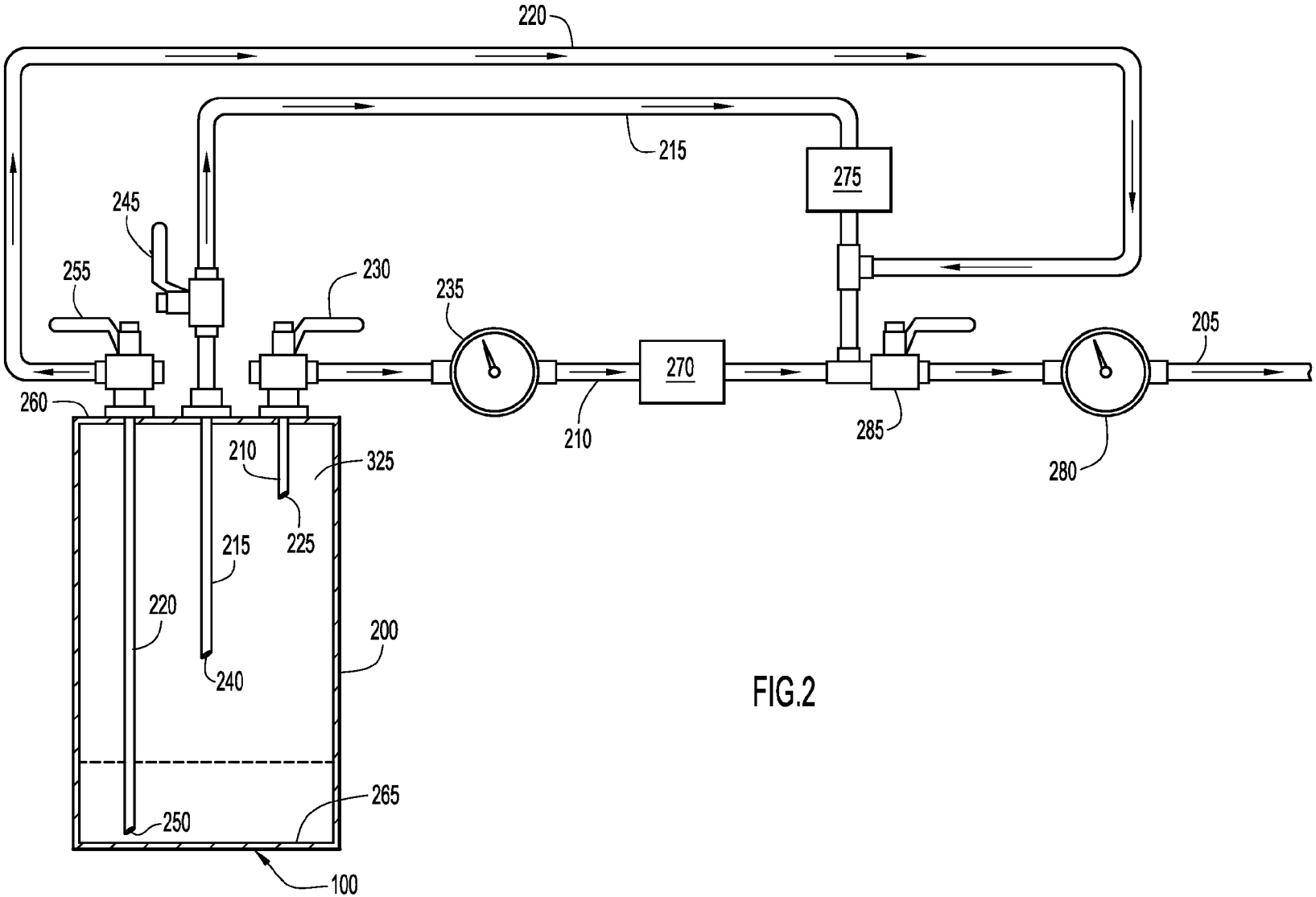
FIG. 2 illustrates schematic of a fluid distribution system for beverage dispensing in accordance with an embodiment of the present invention.
Figure 3:
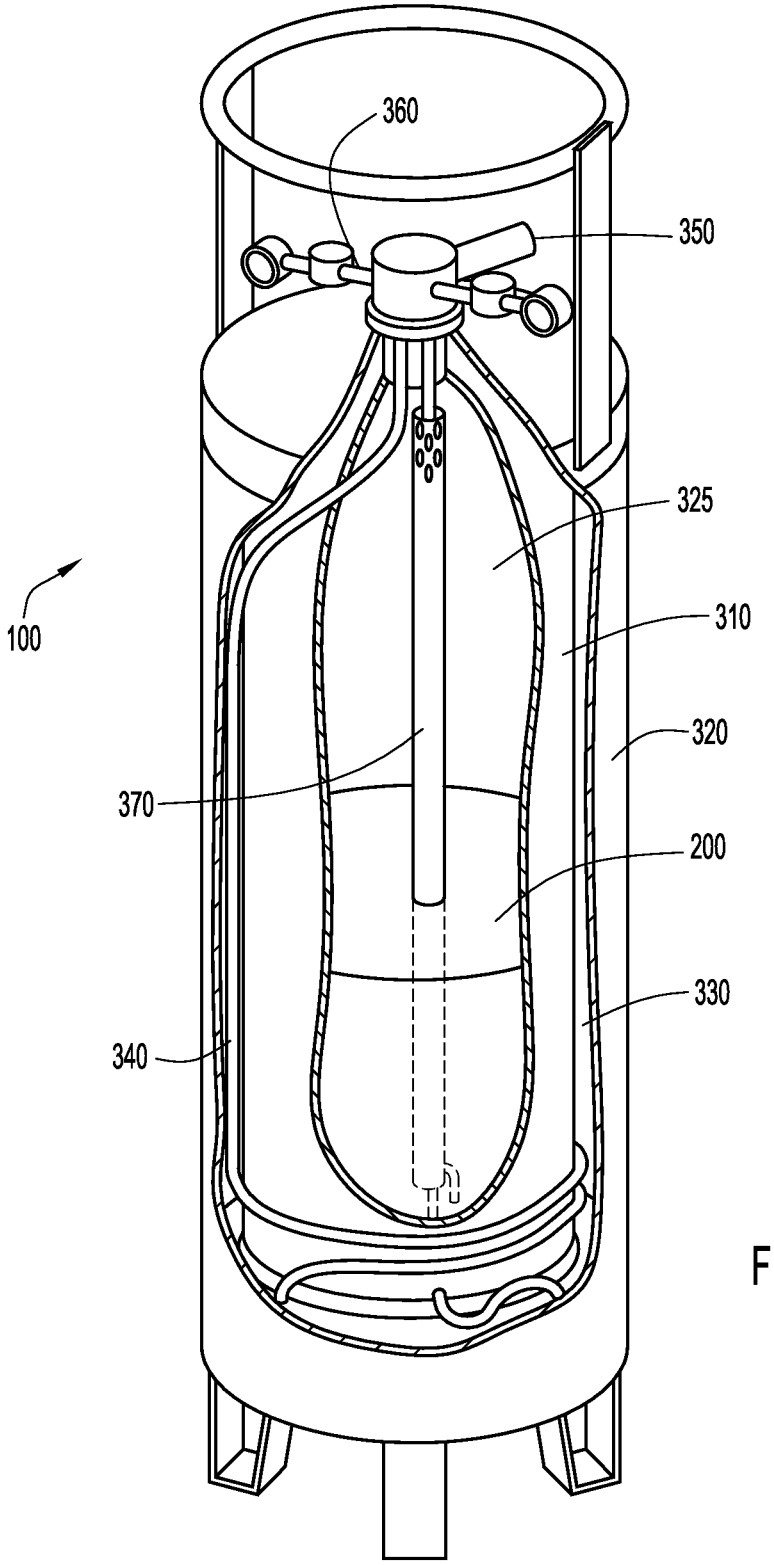
FIG. 3 is a schematic of a storage tank in accordance with an embodiment of the present invention.

FIG. 2 illustrates a fluid storage system 20 in accordance with an embodiment of the present invention. As shown, the system includes the storage vessel or tank 100 that stores fluid (liquid 200 and gas) under pressure. By way of example, the fluid may be carbon dioxide ($CO_2$) and/or Nitrogen ($N_2$). The storage tank 100 may include, but is not limited to, generally cylindrical tanks. FIG. 3 illustrates a storage tank 100 in accordance with an embodiment of the present invention. As shown, the storage tank 100 includes an inner vessel 310 nested within an outer vessel 320. The fluid is stored within the inner vessel 310 as both a liquid 200 and a gas. That is, the liquid stored within the inner vessel 310 vaporizes into gas, which becomes trapped in the area above the liquid surface called a gas space 325.

The dimensions of the inner vessel 310 are smaller than the outer vessel 320; moreover, the inner vessel 310 is generally coaxial with the outer vessel 320. As a result, a generally annular gap 330 exists between the vessels 310, 320. This gap 330 provides a vacuumed space that insulates the fluid contained within the inner vessel 310 from the unwanted entry of heat. The gap 330 may further include insulation that minimizes the entry of unwanted heat into the fluid stored in the inner vessel 310.

The tank 100 may also include a vaporizer coil 340 disposed around the interior wall of the outer vessel 320. The coil 340 is utilized to selectively heat the inner vessel 310 to encourage vaporization of the liquid 200, as desired. The tank 100 may further include a fill circuit 350 to permit transfer of fluid into the inner vessel 310 (for refilling) and a relief valve 360 to permit escape of excess (dangerous) pressure from the inner vessel 310 (e.g., pressures in excess of 300 psi).

The storage tank 100 may include an optional fluid level gauge that estimates the amount of pressurized fluid remaining in the tank. By way of specific example, a floating magnetic rod 370 (called a float rod) may be utilized to monitor the level of liquid 200 within the inner vessel 310. As the level of liquid 200 in the tank 100 decreases, the vertical position of the float rod 370 changes. The float rod 370 is in communication with a gauge that presents a reading to a user based on the rod's vertical position. In this manner, the gauge provides a measurement reading that estimates of the amount of liquid 200 contained within the tank 100.

The storage tank 100 may further include an optional pressure building regulator configured to maintain the internal pressure of the interior vessel 310 at the desired level for supplying the pressurized fluid to the beverage dispensing system. By of example, the pressure building regulator may maintain the pressure of the inner vessel 310 at approximately 125 psi. In addition, the storage tank 100 may include a contents/pressure gauge (that indicates the status of the fluid inside the inner vessel 310). Commercially available storage tanks 100 include the Carbo-Mizer™ 450 series and 750 series storage tanks available from Chart Industries, Inc. (Burnsville, Minn.).

Turning back to FIG. 2, a conduit assembly, in fluid communication with the storage tank 100, selectively directs fluid from the storage tank to the beverage dispensing system (e.g., to the beverage source) via a supply conduit or tube 205. The conduit assembly includes a first or high-pressure conduit or tube 210, a second or intermediate pressure conduit or tube 215, and a third or low pressure conduit or tube 220 (also called a reserve conduit). The first conduit 210 includes a first conduit inlet 225, a first conduit valve 230 (also called a gas isolation valve), and a pressure gauge 235. The valve 230 controls the flow of gas through the conduit 210. Specifically, the valve 230 may be opened and closed to selectively permit the flow of gas downstream to the supply conduit 205. The pressure gauge 235, located downstream from the first conduit valve 230, monitors the pressure of the storage tank 100.

The inlet 225 of the first conduit 210 is oriented at a first vertical position within the storage tank 100. Specifically, the first inlet 225 is oriented at a height effective to draw vaporized fluid from the gas space 325 and into the first conduit 210. With this configuration, the first conduit 210 is configured to direct fluid to the supply conduit 205 when the tank 100 is under high pressure conditions. In particular, the first inlet 225 may be configured such that it directs gas to the supply conduit 205 when the storage tank 100 has an internal pressure in the range of about 160 psi-300 psi.

Similarly, the second conduit 215 includes a second inlet 240 and a second conduit valve 245 (also called a liquid isolation valve). The valve 245 controls the flow of fluid through the second conduit 215 since it may be opened and closed to selectively permit the flow of gas downstream. The second inlet 240 is oriented at a second vertical position within the storage tank 100 (i.e., at a height different from the first inlet 225). That is, the second inlet 240 is oriented at a height effective to draw liquid 200 from the storage tank 100. With this configuration, the second conduit 215 is configured to direct fluid to the supply conduit 205 when the tank is under intermediate pressure conditions. By way of specific example, the second inlet 240 may be configured to draw in liquid 200 when the storage tank 100 possesses an internal pressure in the range of about 140-160 psi. Typically, the tank pressure falls within this intermediate pressure range once all of the gas from the gas space 325 has been depleted.

At least a portion of the pressurized fluid will be drawn into the second conduit 215 as a liquid 200 during the lifespan of the fluid source; consequently, the liquid must be vaporized before it reaches the supply conduit 205. For this reason, the second conduit 215 should possess a length sufficient to provide ample vaporization time for the liquid 200. By way of example, the length of the second conduit 215 may be approximately 25 feet.

The third conduit 220 includes a third inlet 250 and a third or reserve valve 255 (also called a liquid reserve access valve). The reserve valve 255 controls the passage of fluid through the third conduit 220—it may be opened and closed to selectively permit the flow of fluid downstream. The third inlet 250 is oriented a third vertical position within the storage tank 100 (i.e., at a height different from the first inlet 225 and second inlet 240). Specifically, the third inlet 250 is positioned at a height (from the bottom of the tank) effective to draw liquid 200 from the storage tank 100 under low pressure conditions existing when the fluid level within the storage tank is low. By way of specific example, the third conduit 220 is configured to direct fluid toward the supply line 205 when the internal pressure of the vessel is in the range of about 110-140 psi.

With the above-described configuration, the third conduit 220 functions as a reserve conduit, drawing out and directing any remaining liquid toward the supply conduit 205, as well as directing any remaining gas (e.g., gas prevented from flowing downstream along the first 210 or second 215 conduits) toward the supply conduit 205. As with the second conduit, fluid traveling through the third conduit begins as liquid 200, but vaporizes while traveling along the conduit 220.

The height at which each inlet 225, 240, 250 is located may be any height suitable for its described purpose. By way of example, the inlet 225 of the first conduit 210 may be oriented within the gas space 325 of the storage tank 100 (e.g., proximate the top 260 of the tank 100), e.g., about 10-16 inches from the top 260 of the storage tank 100 (e.g., 15.75 inches). The inlet 240 of the second conduit 215, furthermore, may be positioned below the first inlet and within the lower half of the storage tank 100 (i.e., below the vertical mid point of the storage tank 100). In an embodiment, the height of the second inlet 240 is positioned such that 10-25% of the total storage tank capacity remains for reserve purposes. It is important to note that by adjusting the height of the second inlet 240, the reserve capacity provided by the system can be set to a desired level of overall tank capacity. Finally, the inlet 250 of the third conduit 220 is oriented lower than the second inlet 240, e.g., proximate the bottom 265 of the storage tank 100.

The conduit assembly may further include one or more highpoint/pressure regulators disposed along selected conduits. As shown in FIG. 2, the first conduit 210 includes a first highpoint regulator 270 operable to permit passage of fluid having a pressure in excess of a first, set point. By way of example, the highpoint regulator may be set to permit passage of fluid at high pressure, i.e., pressure in a range of about 150-170 psi (e.g., about 160 psi). Fluid at a pressure value above this set point would be permitted to pass downstream to the supply conduit 205, while fluid having a pressure value below the set point would not permitted to pass to the supply conduit.

Similarly, the second conduit 215 may include a second highpoint regulator 275 operable to permit intermediate pressure fluid therethough. Specifically, the highpoint regulator 275 of the second conduit 215 may be set in a range of about 130-150 psi (e.g., about 140 psi). Fluid at a pressure value above this set point would be permitted to pass downstream to the supply conduit 205, while fluid having a pressure value below the set point would not permitted to pass downstream.

The highpoint regulator 270, 275 may be any regulator suitable for its described purpose. By way of example, the highpoint regulators 270, 275 may be in the form of a cryogenic line regulator (also called an economizer). These types of regulators are available from RegO® Products (Elon, N.C.). In addition, the set point values of the first 270 and second 275 highpoint regulators is not particularly limited, so long as a sufficient offset exists between the high pressure set point and the intermediate pressure set point. By way of example, the offset value may be approximately 20 psi. Thus, when the first set point value is about 160 psi, the second set point value is about 140 psi.

As discussed above, each of the storage tank conduits 210, 215, 220 is in fluid communication with the supply conduit 205. The supply conduit 205, in turn, is in fluid communication with the beverage dispensing system and the beverage source (beer keg, syrup, etc.). The supply conduit 205 includes a supply pressure regulator 280 and/or a supply control valve 285 (also called a supply pressure shut-off valve). The supply pressure regulator 280 regulates the pressure of the fluid permitted to flow downstream toward the beverage system, directing gas having a predetermined pressure value toward the syrup/beverage source. By way of example, the supply pressure regulator 280 may be configured to maintain a flow of gas having a pressure of about 90-120 psi (e.g., 110 psi). The supply control valve 285 controls the flow of fluid through the supply conduit 205 since the valve 285 is opened and closed to selectively permit the flow of fluid downstream. Each conduit 210, 215, 220 may coupled to the supply conduit 205 at a point that is upstream from the supply pressure regulator 280 and the supply valve 285.

Figure 4:
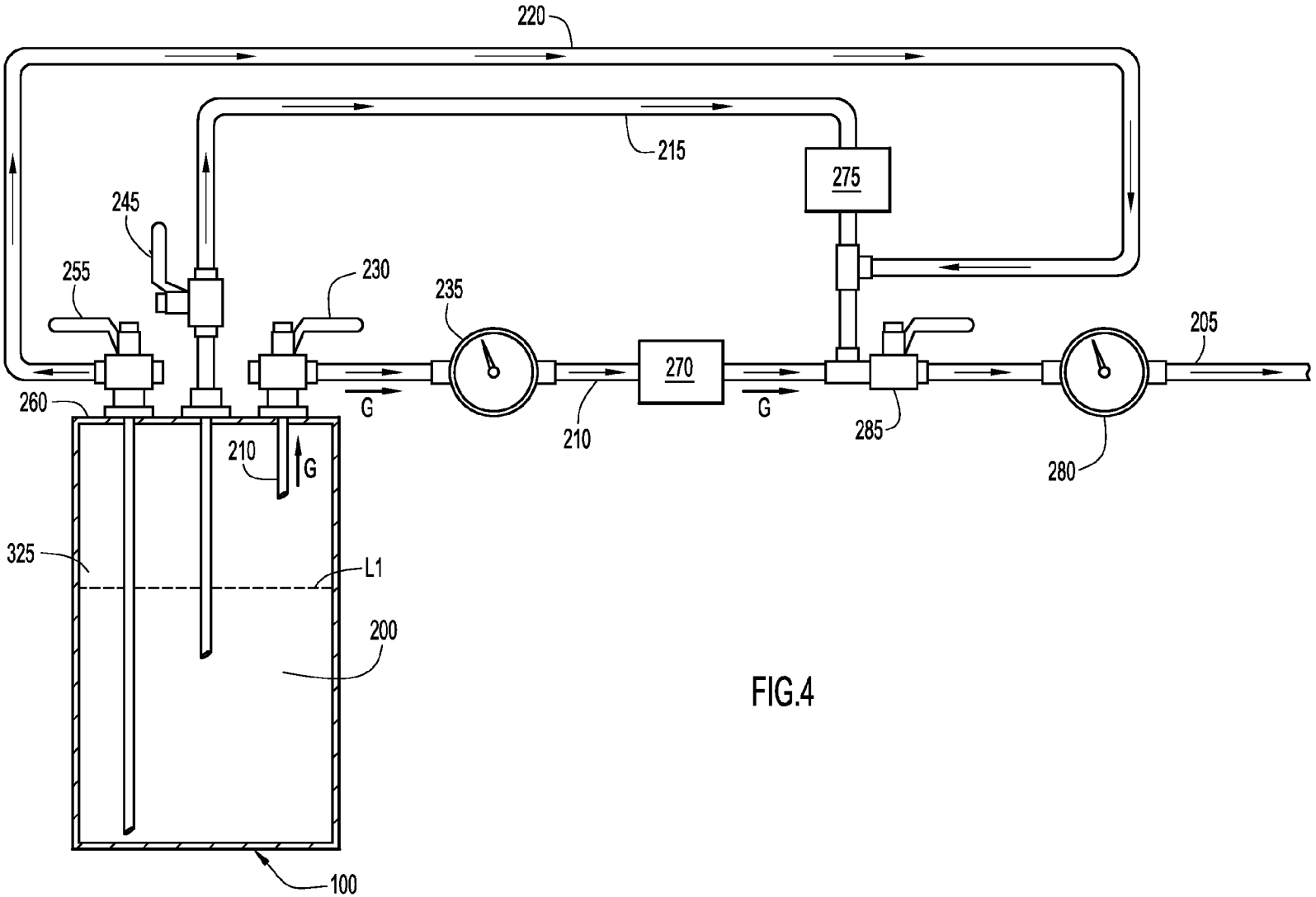
FIGS. 4-6 illustrate the operation of the system shown in FIG. 2.
Figure 5:
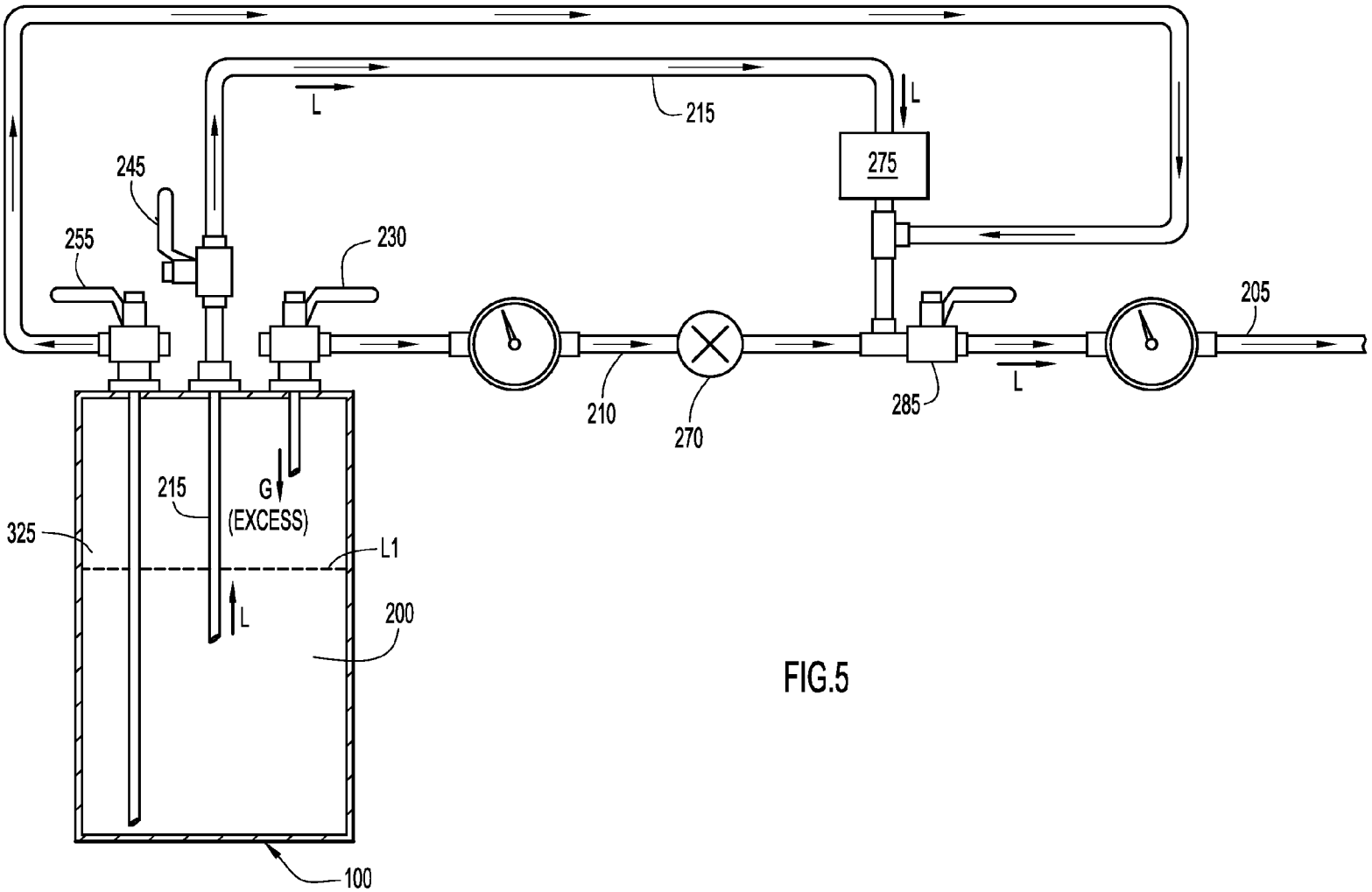
Figure 6:
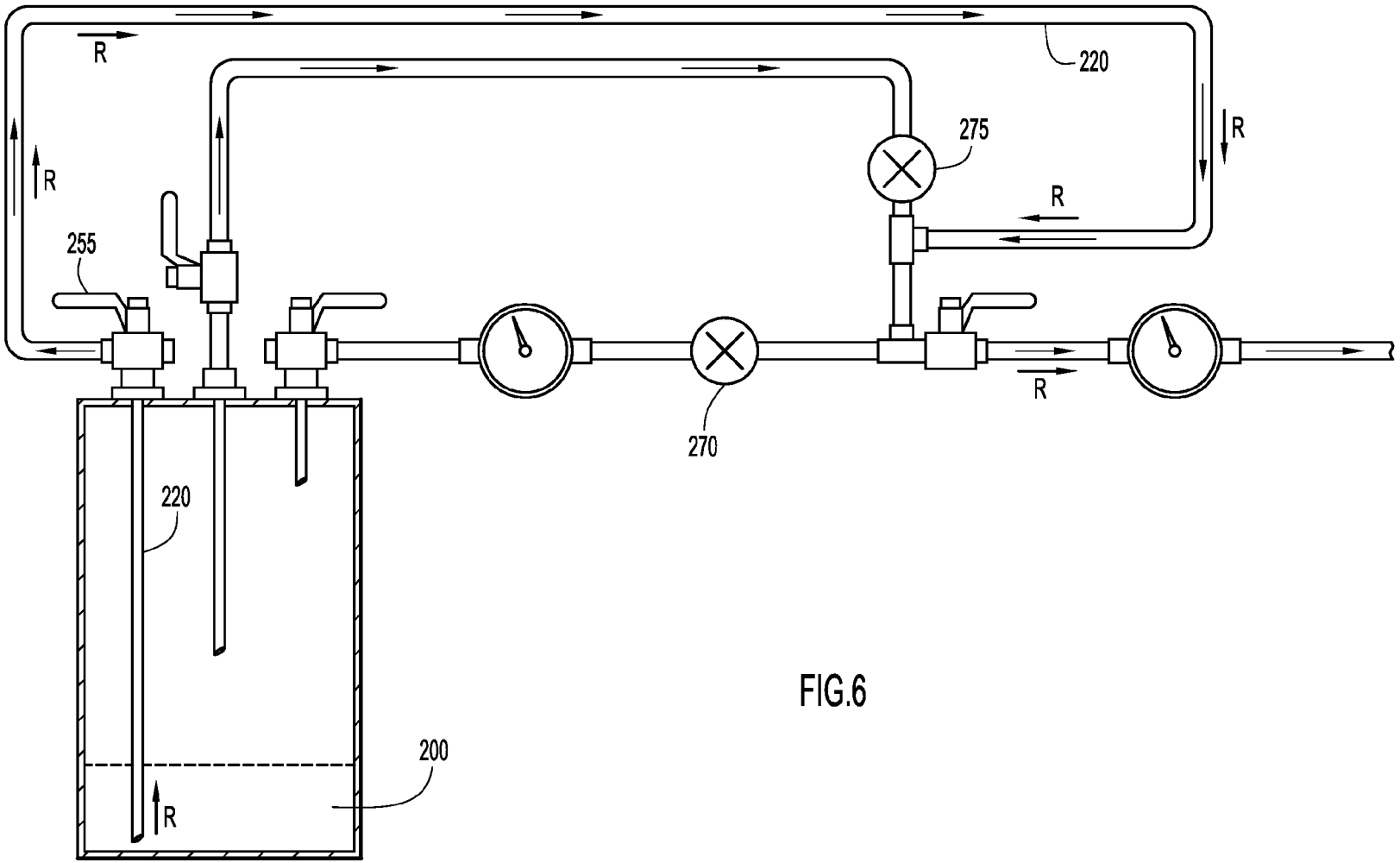

The operation of a system in accordance with the present invention may be explained with reference to FIGS. 4-6. The storage tank 100 begins in its filled state as shown in FIG. 4. In its filled state, the level L1 of liquid 200 within the storage tank 100 is high, corresponding to a high tank pressure (e.g., at least about 160 psi). As explained above, the liquid 200 gradually vaporizes; consequently, the fluid exists in both liquid and gas forms within the storage tank 100. In its operative state, the valves 230, 245 of the first 210 and second 215 conduits are set to their open position, as is the valve 285 on the supply conduit 205. The valve 255 of the reserve conduit 220, however, is set to its closed position.

The vaporized fluid present in the gas space 325 enters the first conduit 210 (via the first inlet 240) and travels downstream to the first conduit highpoint regulator 270 (indicated by arrows G). The highpoint regulator 270, set at 160 psi, permits gaseous fluid to pass through to the beverage dispensing system whenever the pressure of the storage tank 100 is over 160 psi. The liquid 200 within the storage tank 100 will continue to vaporize, and as long as the storage tank 100 maintains a pressure of at least about 160 psi, the gas will continue to flow through the first conduit 210, past the first highpoint regulator 270, and to the supply line 205.

As the fluid is utilized by the beverage system, the internal pressure of the storage vessel 100 eventually falls below the high pressure set point (e.g., 160 psi). As a result, the first highpoint regulator 270 no longer permits the flow of gas along the first conduit 210. Liquid, however, continues to be drawn through the second conduit 215. FIG. 5 shows the liquid 200 being drawn through the second conduit (indicated by arrows L), with the liquid 200 vaporizing as it travels toward the second highpoint regulator 275. In addition, any vaporized fluid blocked by the first highpoint regulator 270 may enter the second conduit 215 (indicated by arrow G excess). Thus, as long as the tank pressure is at least about 140 psi, the pressurized fluid (liquid and gas) will flow through the second highpoint regulator 275 and to the supply conduit 205.

It is important to note that during the product lifecycle, a dynamic pressure situation may exist within the storage tank 100. That is, the internal pressure may "seesaw" between the high and intermediate pressure conditions. As this occurs, the appropriate regulator 270, 275 is engaged, permitting the gas/fluid to pass through the supply conduit 205 and regulating the pressure within the storage tank 100.

As the fluid continues to be directed toward the supply conduit 205, the pressure within the storage tank 100 continues to drop. Once the pressure drops below the intermediate set point (e.g., below about 140 psi), the second highpoint regulator 275 no longer permits fluid to pass through to the supply conduit 205. As explained above, the reserve valve 255 on the third conduit 220 is closed. Thus, once the storage tank 100 pressure drops below about 140 psi, the flow of fluid to the supply conduit 205 stops. At this point, a predetermined (e.g., 75-90%) amount of the fluid in the tank 100 has been expended. As such, the fluid level L2 within the storage tank 100 is low (see FIG. 6).

To restart the flow of fluid to the supply conduit 205, a user turns the reserve valve 255 to its open position. The third conduit 220 draws the remaining fluid from the tank, directing the fluid toward the supply line 205 (indicated by arrows R).

In this manner, the second highpoint regulator 275 stops flow of fluid once the pressure within the storage tank 100 falls below the intermediate set point value. Since the tank pressure generally correlates to the fluid level within the tank 100, the second highpoint regulator 275 effectively designates a reserve fluid level, i.e., an amount of fluid that should remain after temporary stoppage of fluid flow. This temporary stoppage of fluid flow functions as a warning system to a user, indicating that that existing level of fluid in the storage tank 100 is dangerously low. The remaining fluid left in the storage tank 100, however, provides the user with time to replenish the supply. For example, the user may now contact a supplier to order additional fluid and set up delivery. Thus, the above described system prevents a user from depleting the amount of fluid before additional fluid can be ordered. This avoids a situation in which the beverage system becomes inoperable without warning.

The above-described system is a marked contrast from conventional systems since it draws fluid from three separate vertical heights within the storage tank. In contrast, conventional systems draw gas only from the gas space 325.

Figure 7:
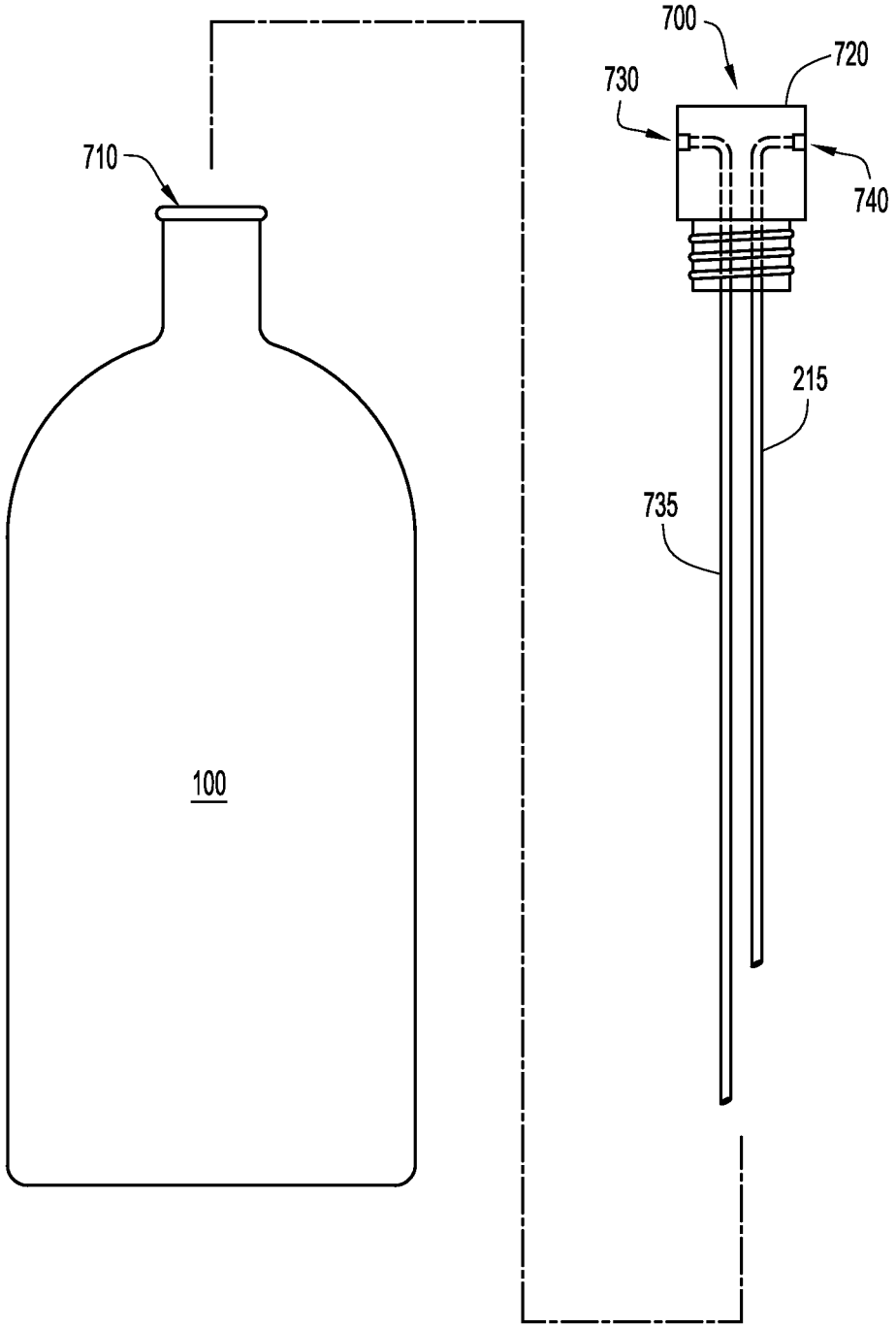
FIG. 7 illustrates an adapter for a storage tank in accordance with an embodiment of the invention.

FIG. 7 illustrates an adapter in accordance with an embodiment of the invention that may be utilized to retrofit a conventional storage vessel with a single port, providing the vessel with a fluid gauge and main draw line as described above. As shown, the adapter 700 may be coupled to the mouth 710 of the storage vessel or tank 100 (e.g., via threaded engagement). The 700 adapter includes a body 720 having a first connection port 730 for a gauge conduit 735 (e.g., a tube) connected to a differential pressure gauge that is operable to indicate provide a measurement of the amount of fluid left in the vessel. The adapter 700 further includes a second connection port 740 for the second conduit 215 (i.e., the main liquid draw tube). In this embodiment, the first 210 and third conduits 220 are integrated into the vessel 100. The adapter 700 enables a user to retrofit a conventional tank, with a line integrated into the vessel now becoming the reserve conduit. Thus, the adapter 700 adapts a conventional vessel to enable it to operate as described above, converting a single port tank into the multi-pressure zone port described above, and providing the vessel with a built in reserve.

While the invention has been described in detail and with reference to specific embodiments thereof, it will be apparent to one skilled in the art that various changes and modifications can be made therein without departing from the spirit and scope thereof. For example, while a beer dispensing system is illustrated, the disclosed supply system for pressurized fluid may be utilized with other beverage systems, including, but not limited to soda, as well as other pressurized fluid supply systems in general. In addition, the pressurized fluid source is not particularly limited. While a $CO_2$ fluid source is discussed, other fluid sources are intended to fall within the scope of the invention (e.g., nitrogen, helium, argon, etc).

The conduits 205, 210, 215, 220 may be formed of any suitable material. By way of example, the conduits may be steel tubing having an outer diameter of approximately 0.25 inches. The first 210 and second 215 conduits may connect to the supply conduit 205 upstream of the supply pressure regulator 280, while the third conduit 220 may be connected to the supply conduit 205 at a point downstream of the supply pressure regulator 280.

Vaporizer coils may be placed between the inner 310 and outer 320 vessels of the tank 100 such that heat enters the vaporizer coil at point tangent to outer vessel. Alternatively, external coils may be utilized, in which heat enters vaporizer coils through entire surface area of coil increasing the vaporization rate within the tank 100 and maximizing flow capabilities.

The pressure ranges permitted by the various pressure regulators in accordance with the present invention are not particularly limited. While a high set point threshold value of 160 psi provided, other high set point threshold values may be utilized. For example, the high set point threshold value may be 180 psi. It should be noted that gases such as $CO_2$ turn into dry ice below a pressure of about 60 psi. Consequently, the pressure of the storage tank 100 is preferably maintained above 60 psi (e.g., via a conventional pressure building control circuit). The operating pressure of the tank 100 is preferably maintained in a range of 140 psi to 300 psi.

The above described system works most efficiently when the initial (full) pressure value of the storage tank 100 is greater than intermediate set point value (e.g., greater than 140 psi). Thus, to insure the pressure of the tank 100 remains above 140 psi after filling or refilling, the system may optionally include a sure-fill assembly and a fill line check valve. A sure-fill assembly automatically relieves the pressure in the tank 100 once it reaches a predetermined value (e.g., 200 psi) through vent plumbing that is routed out to the fill port connection. For example, the sure-fill assembly may include a ball and spring valve that permits pressure over a predetermined value to pass out of the tank 100 during filling. Thus, the pressure of the storage tank 100 is maintained at a predetermined pressure value during filling, with the predetermined value being a value that is greater than the intermediate set point value (e.g., 140 psi). Sure-fill assemblies are commercially available.

Note that although manual valves are illustrated herein, solenoid operated control valves may be utilized to facilitate remote operation of the system without departing from the scope of the present invention.

It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration. Thus, it is intended that the present invention covers the modifications and variations of this invention provided they come within the scope of the appended claims and their equivalents.

What is claimed is:

1. A pressurized fluid system comprising:

a storage tank including a cavity configured to store fluid under pressure;

a first conduit in fluid communication with the storage tank cavity and configured to direct fluid within the cavity downstream toward a supply line, the first conduit including a first inlet disposed at a first vertical position within the cavity and a first regulator disposed downstream from the first inlet, the first regulator permitting fluid flowing from the cavity having a pressure value above a first threshold pressure value to flow downstream toward the supply line and preventing fluid having a value below the first threshold pressure value to flow downstream toward the supply line, wherein the first conduit directs the fluid stored within the cavity toward the supply line when an operational pressure value of the cavity falls within a first predetermined pressure range;

a second conduit in fluid communication with the storage tank cavity and configured to direct fluid within the cavity downstream toward the supply line, the second conduit including a second inlet disposed at a second vertical position within the cavity that is below the first vertical position and a second regulator disposed downstream from the second inlet, the second regulator permitting fluid flowing from the cavity having a pressure value above a second threshold pressure value to flow downstream toward the supply line and preventing fluid having a pressure value below the second threshold pressure value to flow downstream toward the supply line, and wherein the second conduit directs the fluid stored within the cavity toward the supply line when the operational pressure value of the cavity falls within a second predetermined pressure range; and a third conduit in fluid communication with the storage tank cavity, wherein the third conduit directs the fluid stored within the cavity toward the supply line when the operational pressure value of the cavity falls within a third predetermined range, wherein the first predetermined pressure range is greater than each of the second predetermined pressure range and the third predetermined pressure range.

2. The pressurized fluid system of claim 1, wherein the second predetermined pressure range is higher than the third predetermined pressure range.

3. The pressurized fluid system of claim 1, wherein:

the first predetermined pressure range is about 160 psi or more;

the second predetermined pressure range is about 140 psi to about 160 psi; and the third predetermined pressure range is about 110 psi to about 140 psi.

4. The pressurized fluid system of claim 1, wherein:

the first conduit includes a first inlet disposed at a first height within the cavity;

the second conduit includes a second inlet disposed at a second height within the cavity; and the third conduit includes a third inlet disposed at a third height within the cavity.

5. The pressurized fluid system of claim 4, wherein:

the cavity defines a gas space within an upper portion of the cavity; and the first inlet is positioned within the gas space of the cavity.

6. The pressurized fluid system of claim 5, wherein the second inlet is disposed at an intermediate height between the first inlet height and the second inlet height.

7. The pressurized fluid system of claim 4, wherein:

the cavity includes a gas space existing within an uppermost portion of the cavity;

the first inlet is positioned at a height effective to draw vaporized fluid from the gas space;

the second inlet is positioned at a height effective to draw liquid from the cavity; and the third inlet is positioned proximate a floor of the cavity.

8. The pressurized fluid system of claim 7, wherein the height of the third inlet is selected to provide a reserve amount of fluid representing 10%-25% of the cavity storage capacity.

9. The pressurized fluid system of claim 1, wherein the fluid under pressure is carbon dioxide.

10. A pressurized fluid system comprising:

a storage tank including a cavity configured to store fluid under pressure;

a first conduit in fluid communication with the storage tank cavity, the first conduit including a first inlet disposed at a first height within the cavity and a first valve disposed downstream from the first inlet and operable to selectively permit flow of fluid downstream, the first valve being configurable in a closed position and in an opened position;

a second conduit in fluid communication with the storage tank cavity, the second conduit including a second inlet disposed at a second height within the cavity and a second conduit valve disposed downstream from the second inlet and operable to selectively permit flow of fluid downstream, the second valve being configurable in a closed position and in an opened position; and a third conduit in fluid communication with the storage tank cavity, the third conduit including a third inlet disposed at a third height within the cavity, wherein each conduit selectively directs fluid from the cavity depending on an operational pressure value of the cavity, and wherein both the first and second valves are opened to simultaneously permit flow of fluid toward the supply line.

11. The pressurized fluid system of claim 10, wherein the second inlet is disposed at an intermediate height between the first inlet height and the second inlet height.

12. The pressurized fluid system of claim 10, wherein:

the first inlet height is selected to direct fluid toward the supply line when the operational pressure value of the cavity falls within a first range;

the second inlet height is selected to direct fluid toward the supply line when the operational pressure value of the cavity falls within a second range; and the third inlet height is selected to direct fluid toward the supply line when the operational pressure value of the cavity falls within a third range.

13. The pressurized fluid system of claim 12, wherein:

the first pressure range is about 160 psi or more;

the second pressure range is about 140 psi to about 160 psi; and the third pressure range is about 110 psi to about 140 psi.

14. The pressurized fluid system of claim 10, wherein:

the cavity includes a gas space within an uppermost portion of the cavity;

the first inlet is positioned at a height effective to draw vaporized fluid from the gas space;

the second inlet is positioned at a height effective to draw liquid from the cavity; and the third inlet is positioned proximate a floor of the cavity.

15. The pressurized fluid system of claim 10, wherein:

the third conduit comprises a third valve disposed downstream from the third inlet and operable to selectively permit flow of fluid downstream, the third valve being configurable in a closed position and in an opened position; and the system operates in a first mode, in which the first and second valves are opened and the third valve is closed, and in a second mode, in which each of the first, second, and third valves are opened.

16. A system for directing the flow of a pressurized fluid toward a fluid outlet, the system comprising:

a storage tank including a cavity for containing pressurized fluid;

a supply conduit to direct the pressurized fluid from the storage tank cavity to the fluid outlet;

a first conduit in fluid communication with the storage tank cavity, wherein the first conduit directs the pressurized fluid stored within the cavity toward the supply conduit when an operational pressure value of the cavity falls within a first predetermined pressure range;

a second conduit in fluid communication with the storage tank cavity, wherein the second conduit directs the pressurized fluid stored within the cavity toward the supply conduit when the operational pressure value of the cavity falls within a second predetermined pressure range; and a third conduit in fluid communication with the storage tank cavity, wherein the third conduit directs the pressurized fluid stored within the cavity toward the supply conduit when the operational pressure value of the cavity falls within a third predetermined pressure range;

wherein the first predetermined pressure range is greater than each of the second and third predetermined pressure ranges.

17. The system of claim 16, wherein:

the first predetermined pressure range is about 160 psi or more;

the second predetermined pressure range is about 140 psi to about 160 psi; and the third predetermined pressure range is about 110 psi to about 140 psi.

18. The system of claim 17 further comprising:

a first highpoint regulator disposed along the first conduit, the first highpoint regulator configured to permit fluid having a first threshold pressure value to flow downstream toward the supply conduit; and a second highpoint regulator disposed along the first conduit, the second highpoint regulator configured to permit fluid having a second threshold pressure value to flow downstream toward the supply conduit.

19. The system of claim 18 further comprising:

a first conduit valve disposed on the first conduit upstream from the first highpoint regulator, the first conduit valve configurable in a closed position and in an opened position to selectively permit fluid to flow to the first highpoint regulator; and a second conduit valve disposed on the second conduit upstream from the second highpoint regulator, the second conduit valve configurable in a closed position and in an opened position to selectively permit fluid to flow to the first highpoint regulator.

20. The system of claim 19 further comprising a third conduit valve disposed downstream from the third inlet and operable to selectively permit the flow of fluid downstream, the third conduit valve configurable in a closed position and in an opened position, wherein the system operates in a first mode, in which the first and second valves are opened while the third valve is closed, and in a second operational mode, in which each of the first, second, and third valves are opened.

* * * * *

UNITED STATES PATENT AND TRADEMARK OFFICE

CERTIFICATE OF CORRECTION

PATENT NO. : 8,783,527 B2
APPLICATION NO. : 14/010794
DATED : July 22, 2014
INVENTOR(S) : Michael Alan Scott It is certified that error appears in the above-identified patent and that said Letters Patent is hereby corrected as shown below:

In the Claims,

Claim 10, column 9, line 59 delete “conduit” prior to “valve”.

Signed and Sealed this
Twentieth Day of January, 2015

Michelle K. Lee

Michelle K. Lee
*Deputy Director of the United States Patent and Trademark Office*